US005544767A

United States Patent [19]

Daugherty, Jr.

[11] Patent Number: 5,544,767

[45] Date of Patent: Aug. 13, 1996

[54] FREIGHT RAILWAY CAR SLACKLESS DRAWBAR ASSEMBLY

[75] Inventor: David W. Daugherty, Jr., Bolingbrook, Ill.

[73] Assignee: Westinghouse Air Brake Company, Wilmerding, Pa.

[21] Appl. No.: 495,881

[22] Filed: Jun. 28, 1995

[51] Int. Cl.[6] ..... B61G 9/00

[52] U.S. Cl. ..... 213/50.5; 213/62 R; 213/74

[58] Field of Search ..... 213/75 R, 50, 213/50.5, 61, 62 R, 62 A, 63, 69, 71, 72, 74

[56] References Cited

U.S. PATENT DOCUMENTS

| | | | |
|---|---|---|---|
| 1,399,609 | 12/1921 | George | 213/71 |
| 1,557,060 | 10/1925 | Kadel . | |
| 2,240,363 | 4/1941 | Barrows et al. | 213/72 |
| 2,241,353 | 5/1941 | Kinne et al. . | |
| 4,531,648 | 7/1985 | Paton . | |
| 4,555,033 | 11/1985 | Miller . | |
| 4,580,686 | 4/1986 | Elliott . | |
| 4,700,853 | 10/1987 | Altherr et al. . | |
| 4,846,358 | 7/1989 | Rhen . | |
| 4,946,052 | 8/1990 | Kaim et al. . | |
| 5,035,338 | 7/1991 | Kaufhold et al. . | |
| 5,462,179 | 10/1995 | Daugherty et al. | 213/62 R |

*Primary Examiner*—Mark T. Le
*Attorney, Agent, or Firm*—J. O. Ray, Jr.

[57] ABSTRACT

A slackless drawbar assembly connecting adjacent ends of a pair of freight cars together includes a pair of rear draft stop members and a pair of front draft stop members engageable with and securable to a pair of side wall portions of a center sill member disposed along a longitudinal centerline of such car. Each one of at least one of the pairs of rear and front draft stop members having a substantially flat surface portion. There is an elongated drawbar member having an aperture formed therethrough. A ball member has at least a portion thereof disposed in such aperture and a race assembly is secured to such drawbar member adjacent such aperture and having an inner surface thereof surrounding such at least a portion of such ball member disposed in such aperture. A pair of elongated shaft members extend outwardly from radially opposed sides of such ball member. Each of such pair of shaft members includes at least a portion thereof being wedge shaped. A pair of wedge members engage respective surfaces of such wedge shaped portion of such pair of shaft members and such substantially flat surface portion of each one of such at least one of the pair of rear draft stop members and the pair of front draft stop members. A securing mechanism engages each of the pair of wedge means for securing them to such center sill and thereby securing the assembly to such end of such freight car.

18 Claims, 3 Drawing Sheets

FREIGHT RAILWAY CAR SLACKLESS DRAWBAR ASSEMBLY

FIELD OF THE INVENTION

The present invention relates, in general, to certain selected railway type freight car coupling arrangements of the substantially semipermanent type which are being utilized rather extensively at the present time in the railroad industry to connect the adjacently disposed ends of a pair of such freight cars together in a train consist and, more particularly, the instant invention relates to an improved type of slackless drawbar assembly which will require that only two of the component parts thereof move relative to one another during service in such train consist and that can be utilized to connect such adjacently disposed ends of such pair of such freight cars together in such substantially semipermanent manner and, still more particularly, this invention relates to an improved slackless drawbar assembly in which the surfaces of such two component parts which move relative to each other are maintained lubricated by a substantially permanent lubricating liner member.

BACKGROUND OF THE INVENTION

As is generally quite well known in the railway coupling art, there are a number of different designs for slackless type drawbar assemblies that are in rather widespread service in the railroad industry at the present time. Essentially, each of the different railway car coupler manufacturers has its own particular design for a slackless drawbar assembly that it normally supplies to such railroad industry. Each of such different slackless type drawbar assemblies is utilized to connect the adjacently disposed ends of a pair of freight cars together in a substantially semipermanent manner.

In particular, these slackless type drawbar assemblies, which are in use at the present time, have generally provided the railroad industry with a more modern style freight car coupling arrangement. These slackless drawbar assemblies have substantially eliminated the need for a relatively expensive draft gear assembly as well as other freight car coupling components that were normally required before the introduction of such slackless type drawbar assemblies.

Furthermore, these slackless drawbar assemblies have generally resulted in an overall net decrease in the empty weight of such freight cars. This overall net weight reduction of such freight car is an extremely important factor to be taken into consideration by the user of such railway freight car in view of the ever rising energy cost.

It is believed to be equally well recognized, in the railroad industry, that these slackless drawbar assemblies are primarily installed on a freight car which will be utilized in a dedicated service type of application. Most of the freight cars that are primarily utilized in this dedicated type service normally will not require that they be uncoupled except for routine maintenance and/or possible repair.

By way of example only, such freight cars which generally are used in such dedicated type service will at least include: coal cars, automobile and light truck transport cars and certain tank cars.

Each of such slackless drawbar assemblies which are known to be in use at the present time, however, suffer from at least one important and common disadvantage. This common disadvantage is that these slackless drawbar assemblies all require a significant number of component parts.

Additionally, many of these component parts include a number of certain selected surfaces thereof that are frictionally engaged and are subjected to extremely high loads during in-track service. Furthermore, such frictionally engaged surfaces are periodically required to move relative to one another while under such extremely high loads.

It should be obvious, particularly to persons who are skilled in the relevant mechanical arts, that such relative movement between these frictionally engaged surfaces, particularly when they are in a loaded condition, will quite often result in not only the generation of considerable heat, but also substantial wear of these component parts thereby resulting in relatively frequent and rather costly maintenance having to be carried out. In some of the more severe cases, these freight cars must even be removed from a revenue generating type service for relatively long periods of time.

These slackless type drawbar assemblies have, nevertheless, gained a rather widespread acceptance in the railroad industry over the past several years in spite of the number of disadvantages which were discussed in some detail above. This would be expected, however, because there are a number of significant advantages that were gained by such railroad industry, over the older style standard type coupling arrangements which were and still are being used. Experience has demonstrated that these advantages far outweigh the disadvantages and such slackless drawbar assemblies have proven to the railroad industry over an extended period of time to be quite cost effective.

SUMMARY OF THE INVENTION

The present invention provides an improved slackless drawbar assembly for connecting the adjacently disposed ends of a pair of railway freight cars together in a substantially semipermanent manner. Such slackless drawbar assembly comprises a first pair of substantially vertically disposed rear draft stop members. Such rear draft stop members are engaged with and secured to respective ones of a pair of substantially vertically disposed side wall portions of a center sill member. This center sill member is disposed along a longitudinal centerline of a railway freight car. The assembly further includes a first pair of substantially vertically disposed front draft stop members. Like the rear stop members such pair of front stop members are engaged with and secured to such respective ones of such pair of side wall portions of such center sill member. Each one of at least one of such first pair of rear draft stop members and such first pair of front draft stop members has a substantially flat surface portion. An elongated drawbar member having a predetermined length forms another component part of the drawbar assembly. A first aperture, having a predetermined configuration, is formed through the drawbar member adjacent a first end thereof. A first ball member is provided and has at least a portion thereof disposed in such first aperture. There is a first race assembly secured to the drawbar member adjacent such first aperture. An inner surface of such first race assembly surrounds such at least a portion of such first ball member disposed in the first aperture. Extending outwardly from radially opposed sides of said first ball member for a predetermined distance is a first pair of elongated shaft members. Each of such first pair of shaft members includes at least a portion thereof which is wedge shaped. A first pair of wedge members are engaged with respective surfaces of the wedge shaped portion of such first pair of shaft members and with the substantially flat surface portion of such each one of the at least one of the first pair of rear draft stop members and such first pair of front draft stop members. The final essential element of the drawbar assembly is a first securing means that is engaged with each one of such first pair of wedge members for securing them to such center sill and thereby securing such drawbar assembly to such end of such freight car.

OBJECTS OF THE INVENTION

It is, therefore, one of the primary objects of the present invention to provide an improved slackless type drawbar assembly for connecting the adjacently disposed ends of a pair of railway freight cars together which requires a minimum number of component parts that must move relative to one another during in-track service.

Another object of the present invention is to provide an improved slackless type drawbar assembly for connecting the adjacently disposed ends of a pair of railway freight cars together which can be easily retrofitted onto an existing railway freight car.

Still another object of the present invention is to provide an improved slackless type drawbar assembly for connecting the adjacently disposed ends of a pair of railway freight cars together which will provide an enhanced service life.

Yet another object of the present invention is to provide an improved slackless type drawbar assembly for connecting the adjacently disposed ends of a pair of railway freight cars together which will require a minimum amount of maintenance.

A further object of the present invention is to provide an improved slackless type drawbar assembly for connecting the adjacently disposed ends of a pair of railway freight cars together which can have incorporated therein a substantially permanent lubricating liner member between the surfaces thereof which move relative to one another.

It is an additional object of the present invention to provide an improved slackless type drawbar assembly for connecting the adjacently disposed ends of a pair of railway freight cars together which is relatively light weight.

Still yet another object of the present invention is to provide an improved slackless type drawbar assembly for connecting the adjacently disposed ends of a pair of railway freight cars together which is relatively simple to install.

Yet still another object of the present invention is to provide an improved slackless type drawbar assembly for connecting the adjacently disposed ends of a pair of railway freight cars together which is cost effective due to enhanced service life and relatively free maintenance requirements, thereby increasing the time such railway freight cars will be in productive revenue generating service.

A still further object of the present invention is to provide an improved slackless type drawbar assembly for connecting the adjacently disposed ends of a pair of railway freight cars together which does not require any specialized equipment to install.

In addition to the various objects and advantages of the present invention which have been generally described above, there will be various other objects and advantages of the invention that will become more readily apparent to those persons who are skilled in the relevant art from the following more detailed description of such invention, particularly, when such detailed description is taken in conjunction with the attached drawing figures and with the appended claims.

Figure 1:
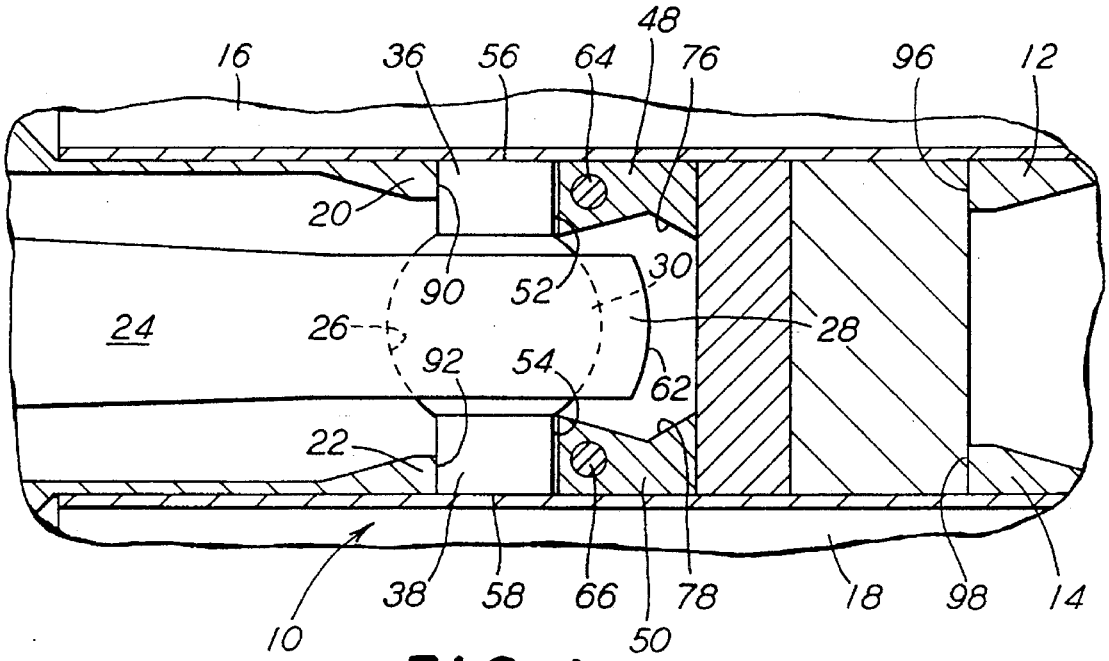
FIG. 1 is a top plan view of one presently preferred embodiment of one end of a slackless drawbar assembly constructed according to this invention.
Figure 2:
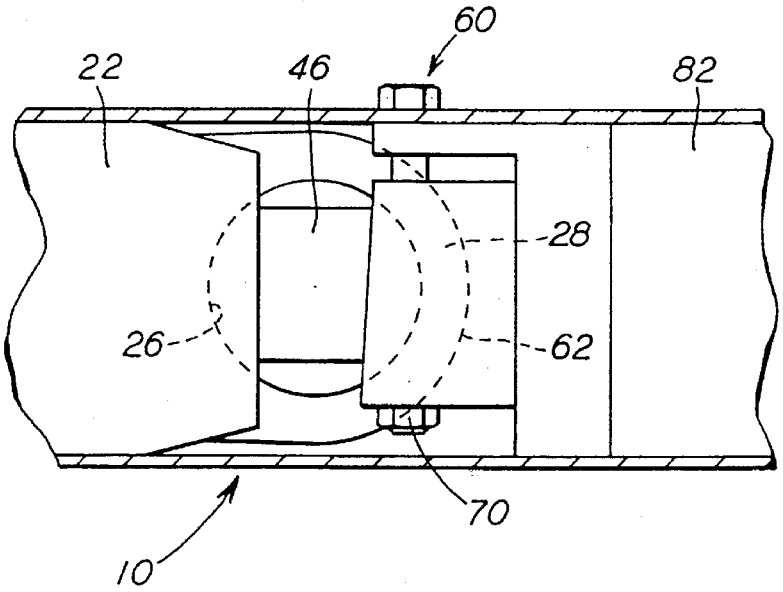
FIG. 2 is a side elevation view of the slackless drawbar assembly illustrated in FIG. 1.
Figure 3:
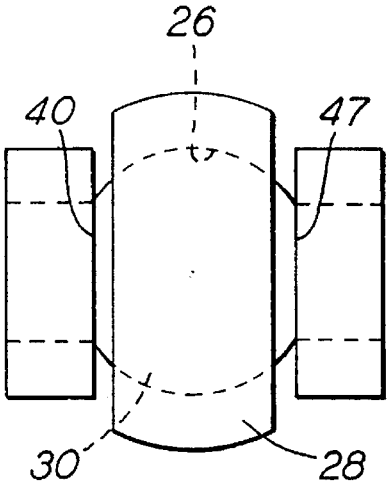
FIG. 3 is a side elevation view, partially in cross section, which illustrates the race assembly disposed around the ball member according to the presently preferred embodiment of the invention.
Figure 7:
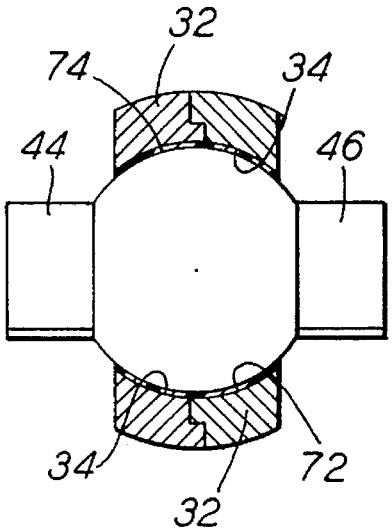
FIG. 7 is a side elevation view of the presently preferred ball member having a pair of shaft members disposed on radially opposed sides thereof.
Figure 4:
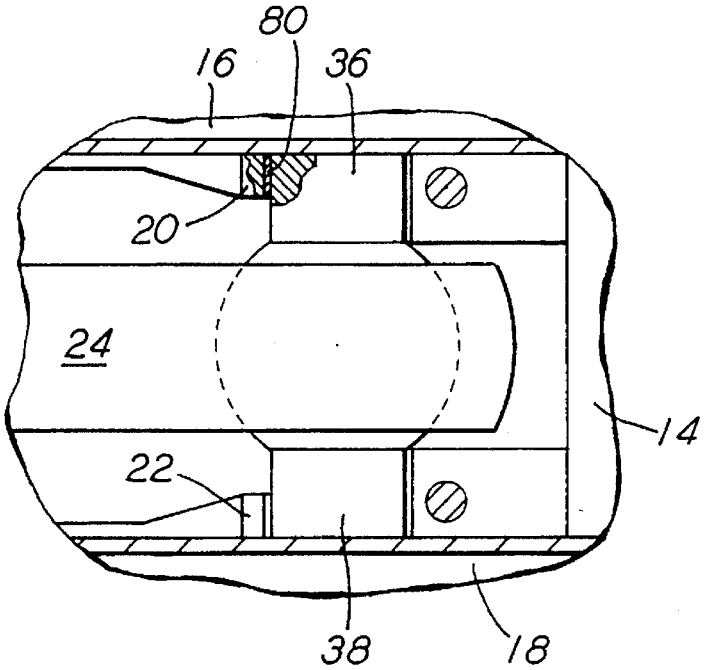
FIG. 4 is a top plan view of one alternative embodiment of one end of a slackless drawbar assembly constructed according to this invention.
Figure 5:
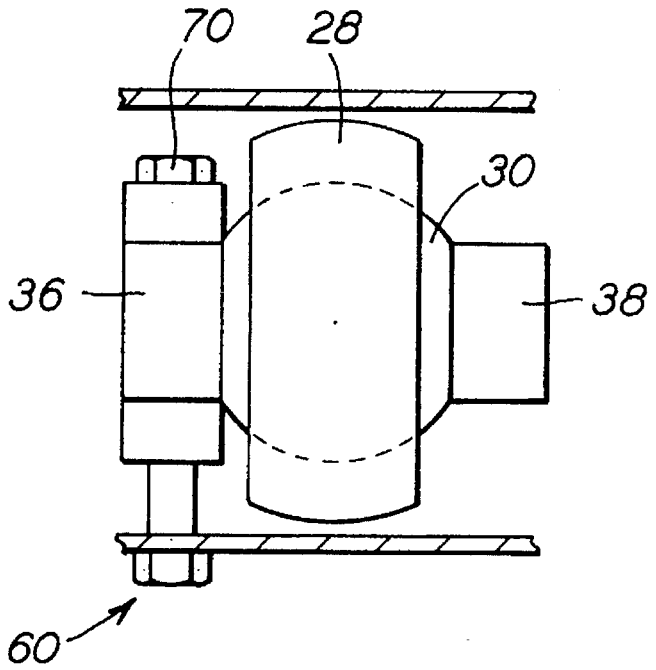
FIG. 5 is a side elevation view, partially in cross section, which illustrates the elongated drawbar disposed around the ball member of the slackless drawbar assembly illustrated in FIG. 4.
Figure 6:
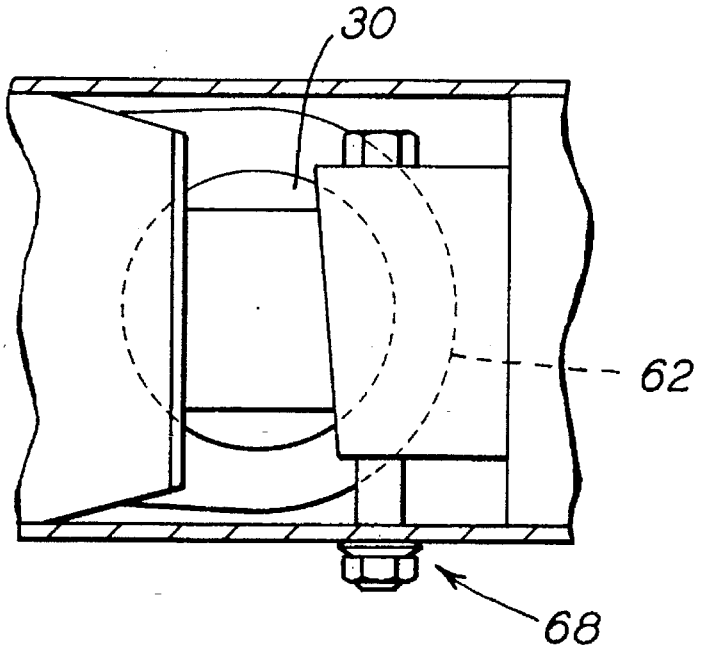
FIG. 6 is a side elevation view of the slackless drawbar assembly illustrated in FIG. 4.

BRIEF DESCRIPTION OF THE PRESENTLY PREFERRED AND VARIOUS ALTERNATIVE EMBODIMENTS OF THE INVENTION

Prior to proceeding to the much more detailed description of the present invention, it should be noted that identical components which have identical functions have been identified with identical reference numerals throughout the several views illustrated in the drawing figures, for the sake of clarity and understanding of the invention.

Now reference is made, more particularly, to the several drawing figures. Illustrated therein is an improved slackless type drawbar assembly, generally designated 10, constructed according to a presently preferred embodiment of the invention. Such drawbar assembly 10 is utilized to connect the adjacently disposed ends (not shown) of a pair of railway freight cars (not shown) together in a substantially semipermanent manner.

The drawbar assembly 10 includes a first pair of rear draft stop members 12 and 14. Each one of such first pair of rear draft stop members 12 and 14 are preferably disposed in a substantially vertical position during service. The first pair of rear draft stop members 12 and 14 are engaged with and secured to respective ones of a pair of similar vertically disposed side wall portions 16 and 18 of the center sill member. Such center sill member is disposed beneath the car body (not shown) and along a longitudinal centerline of a railway freight car.

There is also a first pair of front draft stop members 20 and 22 which are likewise disposed in a substantially vertical position during service. The first pair of front draft stop members 20 and 22 are also engaged with and secured to such respective ones of such pair of vertically disposed side wall portions 16 and 18 of such center sill member. Each one of at least one of such first pair of rear draft stop members 12 and 14 and such first pair of front draft stop members 20 and 22 will include a substantially flat surface portion. Preferably, each one of both the first pair of rear draft stop members 12 and 14 and the first pair of front draft stop members 20 and 22 will include a substantially flat surface portion 96,98 and 90,92, respectively.

In addition, according to one of the presently preferred embodiments of the invention, such each one of the substantially flat surface portions of each one of the at least one of such first pair of rear draft stop members 12 and 14 and such first pair of front draft stop members 20 and 22 will be tapered at a predetermined angle.

Preferably, such taper of such substantially flat surface portion of each one of such at least one of the first pair of such rear draft stop members 12 and 14 and such first pair of front draft stop members 20 and 22 will generally be in a range of between about 8.0 degrees and about 12.0 degrees. In a presently more preferred embodiment of the invention, such taper will normally be about 10.0 degrees.

Furthermore, in the presently more preferred embodiment, each one of each of the first pair of such rear draft stop members 12 and 14 and the first pair of such front draft stop members 20 and 22 will include a substantially flat surface portion. The flat surface portions 96 and 98 disposed on the rear draft stop members 12 and 14 will be disposed substantially in a confronting relationship to the flat surface portions 90 and 92 disposed on such front draft stop members 20 and 22.

Drawbar assembly 10 further includes an elongated drawbar member 24 which has a predetermined length. There is a first aperture 26, having a predetermined configuration, formed through such drawbar member 24 closely adjacent a first end 28 thereof. Drawbar assembly 10, also, includes a first ball member 30, which has at least a portion thereof disposed in such first aperture 26. In addition, a first race assembly 32 is secured to such drawbar member 24 closely adjacent such first aperture 26. This first race assembly 32 includes an inner surface 34 thereof surrounding such at least a portion of the first ball member 30 that is disposed in such first aperture 26.

In the presently preferred embodiment of the slackless drawbar assembly 10, such predetermined configuration of such first aperture 26 formed through the elongated drawbar member 24 adjacent the first end 28 thereof will be generally round and will have a predetermined diameter. Such predetermined diameter of this generally round first aperture 26 formed through such elongated drawbar member 24 closely adjacent the first end 28 thereof is in the range of between about 8.375 inches and about 9.625 inches.

In a still more presently preferred embodiment of the drawbar assembly 10, the predetermined diameter of such first ball member 30 having at least a portion thereof disposed in such first aperture 26 will be between about 8.5 inches and about 9.5 inches. Additionally, in this more preferred embodiment such first race assembly 32 will be designed such that it can be removably secured to the elongated drawbar member 24 adjacent such first aperture 26. Preferably, such first race assembly 32 will be designed such that it can be removably secured to the elongated drawbar member 24, for example, by bolts (not shown). In this slackless drawbar assembly 10, according to this embodiment of the invention, the outermost end surface 62 of the first end 28 of such elongated drawbar member 24 will exhibit a generally convex shape in each of a generally horizontal direction and a generally vertical direction.

There is a first pair of elongated shaft members 36 and 38 which extend outwardly from radially opposed sides 40 and 42 of such first ball member 30 for a predetermined distance. Each one of the first pair of shaft members 36 and 38 have at least a predetermined portion 44 and 46 thereof which is wedge shaped.

In a presently preferred embodiment of the drawbar assembly 10, an outer face 56 of a first one 36 of the first pair of shaft members 36 and 38 will be displaced a distance of between about 12.5 inches and about 12.75 from a radially opposed outer face 58 of a second one 38 of such first pair of shaft members 36 and 38.

A first pair of wedge members 48 and 50 are engageable with respective surfaces 52 and 54 of such wedge shaped portion 44 and 46 of such first pair of shaft members 36 and 38 and such tapered and substantially flat surface portion of such each one of the at least one of such first pair of rear draft stop members 12 and 14 and the first pair of front draft stop members 20 and 22.

A first securing means, generally designated 60, is engageable with each one of such first pair of wedge members 48 and 50 for securing such first pair of wedge members 48 and 50 to such center sill and thereby securing said drawbar assembly 10 to such end of such freight car.

In the presently preferred embodiment, of the slackless drawbar assembly 10, such each one of the first pair of wedge members 48 and 50 includes a respective longitudinal bore 64 and 66 formed therethrough. The respective longitudinal bores 64 and 66 are, preferably, disposed substantially in a vertical direction and such first securing means 60 engageable with each one of such first pair of wedge members 48 and 50 for securing them to such center sill at least includes respective bolts 68 and 70.

In the slackless drawbar assembly 10, according to this embodiment of the invention, the first securing means 60 engageable with such each one of the first pair of wedge members 48 and 50 for securing them to such center sill further includes a means 68 which is engageable with such first pair of wedge members 48 and 50 for exerting a predetermined force on respective ones of this first pair of wedge members 48 and 50. In the most presently preferred embodiment, such means 68 engageable with such first pair of wedge members 48 and 50 for exerting and maintaining such predetermined force on the first pair of wedge members 48 and 50 is a Belleville type washer.

Additionally, in the presently preferred embodiment of the instant invention, such slackless drawbar assembly 10 will further include a shear plug 70. Such shear plug 70 is provided in order to assist in the assembly and installation of the slackless drawbar assembly 10 into such center sill portion of such first freight car.

It should be noted here that the second end (not shown) of the slackless drawbar assembly 10 may have a different configuration than the first end described in detail above and accordingly it is not to be necessarily limited to the following description of such slackless drawbar assembly 10 in which the first end of such slackless drawbar assembly 10 is substantially a mirror image of the second end of such slackless drawbar assembly 10.

Nevertheless, in the presently preferred embodiment of the invention, such slackless drawbar assembly 10 further includes a second pair of vertically disposable rear draft stop members (not shown) which are engageable with and securable to respective ones of a pair of vertically disposed side wall portions (not shown) of a center sill member (not shown) disposed along a longitudinal centerline of an adjacently disposed second railway freight car (not shown).

Likewise, there is a second pair of vertically disposable front draft stop members (not shown) which are engageable with and securable to such respective ones of such pair of vertically disposed side wall portions of such center sill member of such second railway freight car.

As is the case with the first pair of rear draft stop members 12 and 14 and such first pair of front draft stop members 20 and 22, each one of at least one of such second pair of rear draft stop members and such second pair of front draft stop members will, preferably, exhibit a substantially flat surface portion having a taper at a predetermined angle.

A second aperture (not shown), also, having a predetermined configuration, is formed through such elongated drawbar member 24 closely adjacent a second end (not shown) thereof.

In addition, there is a second ball member (not shown) which has at least a predetermined portion thereof disposed in such second aperture. The second ball member, like the first ball member 30, has a predetermined diameter which will, preferably, be substantially the same diameter as such first ball member 30.

Secured to such elongated drawbar member 24 adjacent the second aperture is a second race assembly (not shown). Such second race assembly, like the first race assembly 32, has an inner surface thereof surrounding such at least a portion of the second ball member disposed in such second aperture.

There is a second pair of elongated shaft members (not shown) which extend outwardly from the radially opposed sides of such second ball member for a predetermined distance. Each one of this second pair of shaft members includes at least a portion thereof which is wedge shaped.

According to this embodiment of the invention, there is, also, a second pair of wedge members (not shown). Such second pair of wedge members are engaged with respective surfaces of such wedge shaped portion of such second pair of elongated shaft members and with the tapered and substantially flat surface portion of such each one of the at least one of such second pair of rear draft stop members and the second pair of front draft stop members.

Finally, in the presently preferred embodiment of the invention, there is provided a second securing means (not shown) which engages with each one of such second pair of wedge members in order to secure this second pair of wedge members to such center sill and thereby secure the second end of such drawbar assembly 10 to such end of such second railway freight car.

According to the most presently preferred embodiment of the invention, the slackless drawbar assembly 10 further includes an annular space 72 disposed between respective outer surfaces of such first 30 and second (not shown) ball members and the inner surface of such first 32 and second (not shown) race assemblies and a substantially solid lubricating liner member 74 disposed in such annular space 72.

Further, it is presently preferred that each of such first pair of wedge members 48 and 50 and such second pair of wedge members (not shown) include confronting substantially V-shaped inner surfaces 76 and 78 which enable the required angling movement of such elongated drawbar member 24.

In the presently preferred slackless drawbar assembly 10, such first ball member 30 and the first pair of shaft members 36 and 38 will be formed as a first single piece unit and such second ball member and such second pair of shaft members will likewise be formed as a second single piece unit. After such forming of these first and second single piece units, preferably, they will be forged.

Although it is not believed necessary at the present time, it may be desirable and is within the scope of the present invention to provide hardened wear liner members 80 intermediate the wedge shaped portion of the first pair of shaft members 36 and 38 and the respective flat surface portions 96, 98, 90 and 92 of such first pair of rear draft stop members 12 and 14 and the first pair of front draft stop members 20 and 22. In the event the second end of such slackless drawbar assembly 10 is substantially identical to the first end then such wear liner members may be provided intermediate the wedge shaped portion of the second pair of shaft members (not shown) and the flat surface portions of such second pair of rear draft stop members (not shown) and the second pair of front draft stop members (not shown).

It is further within the scope of the present invention to provide a filler member 82 in the space normally taken up by a draft gear assembly (not shown) when the slackless drawbar assembly 10 of the present invention is to be retrofitted to an existing freight car that was equipped with a standard type coupling arrangement.

While a presently preferred and various additional alternative embodiments of the instant invention have been described in detail above in accordance with the patent statutes, it should be recognized that various other modifications and adaptations of the invention may be made by those persons who are skilled in the relevant art without departing from either the spirit or the scope of the appended claims.

I claim:

1. An improved slackless drawbar assembly for connecting adjacently disposed ends of a pair of railway freight cars together in a substantially semipermanent manner, said slackless drawbar assembly comprising:

(a) a first pair of vertically disposable rear draft stop members engageable with and securable to respective ones of a pair of vertically disposed side wall portions of a center sill member disposed along a longitudinal centerline of a first railway freight car;

(b) a first pair of vertically disposable front draft stop members engageable with and securable to such respective ones of such pair of vertically disposed side wall portions of such center sill member disposed along such longitudinal centerline of such first railway freight car;

(c) each one of at least one of said first pair of rear draft stop members and said first pair of front draft stop members having a substantially flat surface portion;

(d) an elongated drawbar member having a predetermined length;

(e) a first aperture, having a predetermined configuration, formed through said elongated drawbar member adjacent a first end thereof;

(f) a first ball member having at least a portion thereof disposed in said first aperture, said first ball member having a predetermined diameter;

(g) a first race assembly secured to said elongated drawbar member adjacent said first aperture and having an inner surface thereof surrounding said at least a portion of said first ball member disposed in said first aperture;

(h) a first pair of elongated shaft members extending outwardly from radially opposed sides of said first ball member for a predetermined distance, each of said first pair of shaft members having at least a portion thereof being wedge shaped;

(i) a first pair of wedge members engageable with respective surfaces of said wedge shaped portions of said first pair of elongated shaft members, and each said wedge member having a substantially concave side that faces the drawbar member; and (j) a first securing means engageable with each one of said first pair of wedge members for securing said first pair of wedge members to such center sill and thereby securing said first end of said drawbar assembly to such end of such first railway freight car.

2. A slackless drawbar assembly, according to claim 1, wherein each one of each of said first pair of said rear draft stop members and said first pair of said front draft stop members includes said substantially flat surface portion.

3. A slackless drawbar assembly, according to claim 1, wherein said predetermined configuration of said first aperture formed through said elongated drawbar member adjacent said first end thereof is generally round and has a predetermined diameter.

4. A slackless drawbar assembly, according to claim 1, wherein said predetermined diameter of said generally round first aperture formed through said elongated drawbar member adjacent said first end thereof is between about 8.375 inches and about 9.625 inches.

5. A slackless drawbar assembly, according to claim 4, wherein said predetermined diameter of said first ball member having at least a portion thereof disposed in said first aperture is between about 8.5 inches and about 9.5 inches.

6. A slackless drawbar assembly, according to claim 1, wherein said first race assembly is removably secured to said elongated drawbar member adjacent said first aperture.

7. A slackless drawbar assembly, according to claim 1, wherein an outer face of a first one of said first pair of shaft members is displaced a distance of between about 12.5 inches and about 12.75 from a radially opposed outer face of a second one of said first pair of shaft members.

8. A slackless drawbar assembly, according to claim 1, wherein an outermost end surface of said first end of said elongated drawbar member is convexly shaped in each of a generally horizontal direction and a generally vertical direction.

9. A slackless drawbar assembly, according to claim 1, wherein said each one of said first pair of wedge members includes a respective longitudinal bore formed therethrough substantially in a vertical direction and said first securing means engageable with said each one of said first pair of wedge members for securing said first pair of wedge members to such center sill at least includes a bolt.

10. A slackless drawbar assembly, according to claim 9, wherein said first securing means engageable with said each one of said first pair of wedge members for securing said first pair of wedge members to such center sill further includes a means engageable with said wedge members for exerting a predetermined force on said wedge member.

11. A slackless drawbar assembly, according to claim 10, wherein said means engageable with said wedge members for exerting said predetermined force on said wedge member is a Belleville type washer.

12. A slackless drawbar assembly, according to claim 1, wherein said slackless drawbar assembly further includes a shear plug for aiding in assembly of said slackless drawbar assembly into such center sill portion of such first freight car.

13. A slackless drawbar assembly, according to claim 1, wherein said slackless drawbar assembly further includes:

(a) a second pair of vertically disposable rear draft stop members engageable with and securable to respective ones of a pair of vertically disposed side wall portions of a center sill member disposed along a longitudinal centerline of an adjacently disposed second railway freight car;

(b) a second pair of vertically disposable front draft stop members engageable with and securable to such respective ones of such pair of vertically disposed side wall portions of such center sill member disposed along such longitudinal centerline of such second railway freight car;

(c) each one of at least one of said second pair of rear draft stop members and said second pair of front draft stop members having a substantially flat surface portion;

(d) a second aperture, having a predetermined configuration, formed through said elongated drawbar member adjacent a second end thereof;

(e) a second ball member having at least a portion thereof disposed in said second aperture, said second ball member having a predetermined diameter;

(f) a second race assembly secured to said elongated drawbar member adjacent said second aperture and having an inner surface thereof surrounding said at least a portion of said second ball member disposed in said second aperture;

(g) a second pair of elongated shaft members extending outwardly from radially opposed sides of said second ball member for a predetermined distance, each of said second pair of shaft members having at least a portion thereof being wedge shaped;

(h) a second pair of wedge members engageable with respective surfaces of said wedge shaped portions of said second pair of elongated shaft members; and (i) a second securing means engageable with each one of said second pair of wedge members for securing said second pair of wedge members to such center sill and thereby securing said second end of said drawbar assembly to such end of such second railway freight car.

14. A slackless drawbar assembly, according to claim 13, wherein said slackless drawbar assembly further includes an annular space disposed between respective outer surfaces of said first and second ball members and said inner surface of said first and second race assemblies and a substantially solid lubricating liner member disposed in said annular space.

15. A slackless drawbar assembly, according to claim 13, wherein each of said first pair of wedge members and said second pair of wedge members include confronting substantially V-shaped inner surfaces for enabling angling movement of said elongated drawbar member.

16. A slackless drawbar assembly, according to claim 13, wherein said first ball member and said first pair of shaft members are formed as a first single piece unit and said second ball member and said second pair of shaft members are formed as a second single piece unit.

17. A slackless drawbar assembly, according to claim 16, wherein each of said first single piece unit and said second single piece unit is a forging.

18. A slackless drawbar assembly, according to claim 13, wherein said first end of said slackless drawbar assembly is substantially a mirror image of said second end of said slackless drawbar assembly.

* * * * *